US007370862B2

(12) United States Patent
Ahn et al.

(10) Patent No.: US 7,370,862 B2
(45) Date of Patent: May 13, 2008

(54) APPARATUS FOR DETECTING DOUBLE-FEED OF PAPER

(75) Inventors: Jin Hyuk Ahn, Gyunggi do (KR); Dong Sik Lee, Seoul (KR)

(73) Assignee: Nautilus Hyosung Inc. (KR)

( * ) Notice: Subject to any disclaimer, the term of this patent is extended or adjusted under 35 U.S.C. 154(b) by 395 days.

(21) Appl. No.: 11/125,106

(22) Filed: May 10, 2005

(65) Prior Publication Data

US 2006/0157921 A1 Jul. 20, 2006

(30) Foreign Application Priority Data

Dec. 24, 2004 (KR) ..... 10-2004-0112510

(51) Int. Cl.
*B65H 7/02* (2006.01)

(52) U.S. Cl. ..... 271/265.01; 271/258.01

(58) Field of Classification Search ..... 271/265.01, 271/258.01; 399/16, 322, 389; 270/52.15, 270/58.02, 58.03

See application file for complete search history.

(56) References Cited

U.S. PATENT DOCUMENTS 4,431,358 A * 2/1984 Jenkner ..... 414/796
5,101,097 A * 3/1992 Conant ..... 235/449
5,322,269 A * 6/1994 Fukube et al. ..... 271/18.1
5,685,540 A * 11/1997 Kobayashi et al. ..... 271/293
7,038,703 B2 * 5/2006 Ehrhardt ..... 347/171
2004/0085434 A1 * 5/2004 Hayashi ..... 347/218

FOREIGN PATENT DOCUMENTS

JP 4-116043 * 4/1992
JP 4-350029 * 12/1992
JP 6-234440 * 8/1994

* cited by examiner

*Primary Examiner*—Patrick Mackey
*Assistant Examiner*—Thomas A. Morrison
(74) *Attorney, Agent, or Firm*—Fish & Richardson P.C.

(57) ABSTRACT

Disclosed are an apparatus and method for detecting double-feed of paper to prevent banking accidents or jam in a paper handling machine for handling paper, sheets of currency note are not separated by a sheet separating means and thus plural sheets are double fed. The apparatus includes paper feeding means for guiding upper and lower surfaces of the paper and feeding the paper, a pivot member pivotally installed to a rotary shaft, and having a contact portion disposed in a paper feeding path of the paper feeding means and contacting with one surface of the feeding paper, and an encoder portion with a plurality of slits, in which the rotary shaft is closer to the contact portion rather than the encoder portion, and a sensor for counting the number of slits of the encoder portion when the pivot member pivots. The present invention can accurately detect the overlay of the paper having a thin thickness with a simple construction. Also, the present invention can detect the overlay of the paper, regardless of a size and thickness of the paper and a transferring direction of the paper.

1 Claim, 4 Drawing Sheets

*[Fig. 1]*
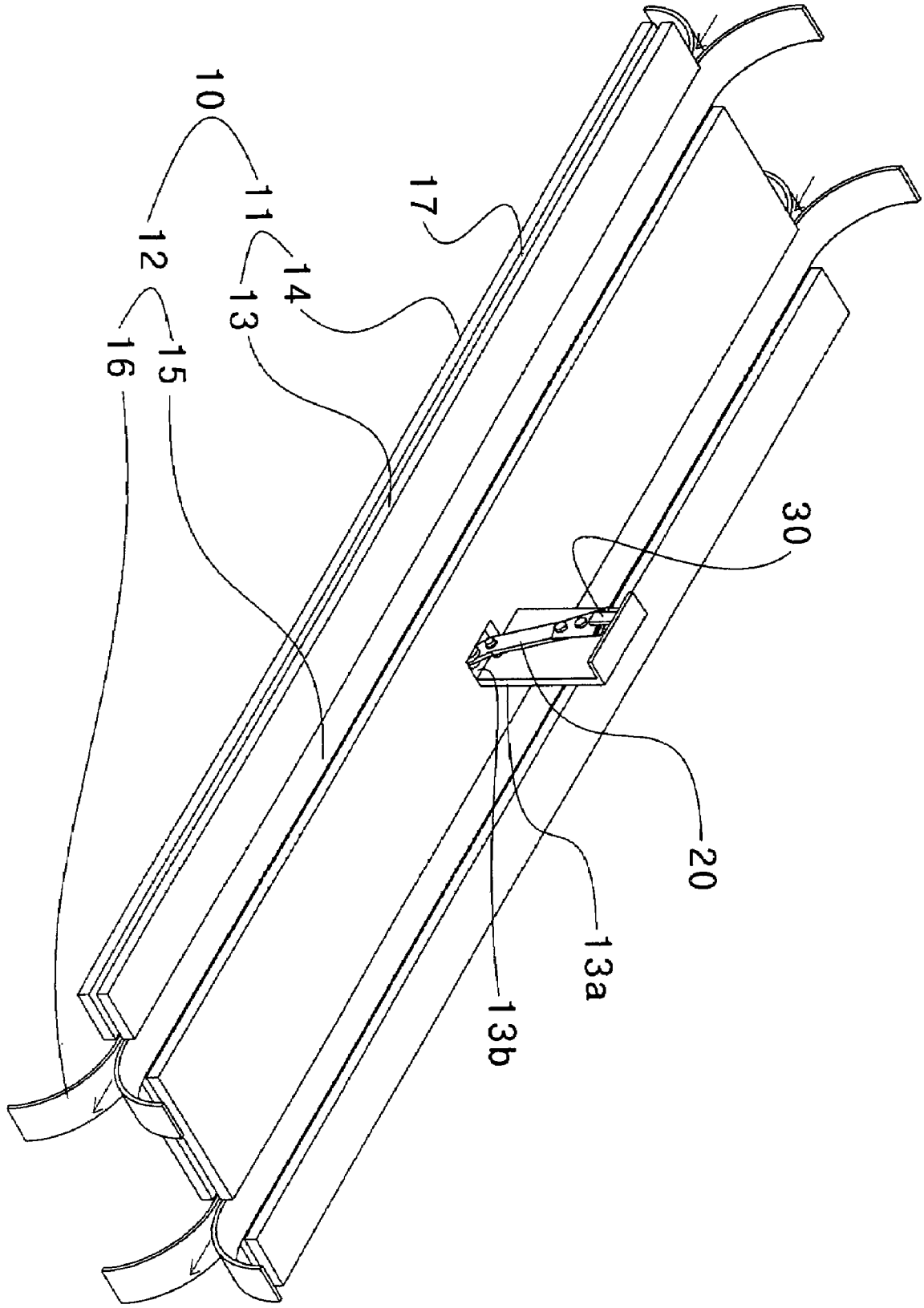

*[Fig. 2]*
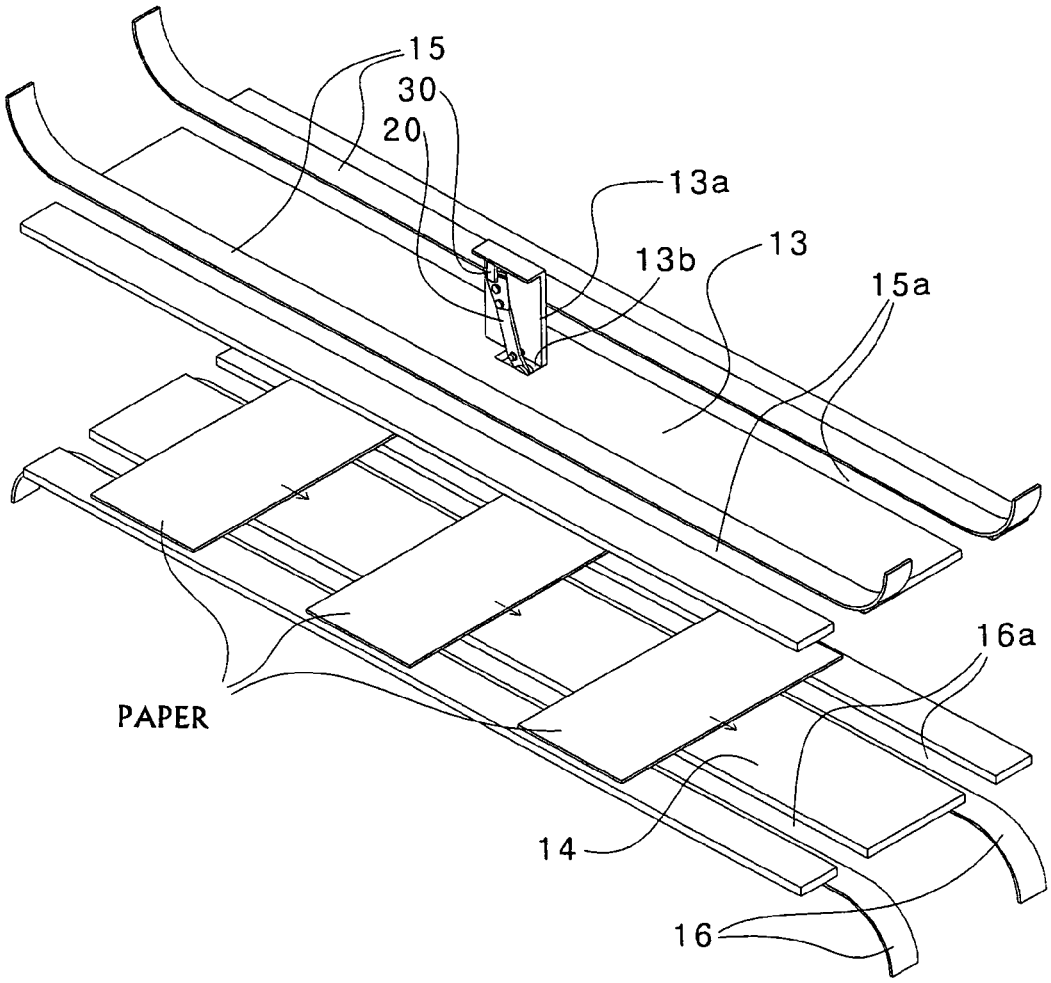

*[Fig. 3]*
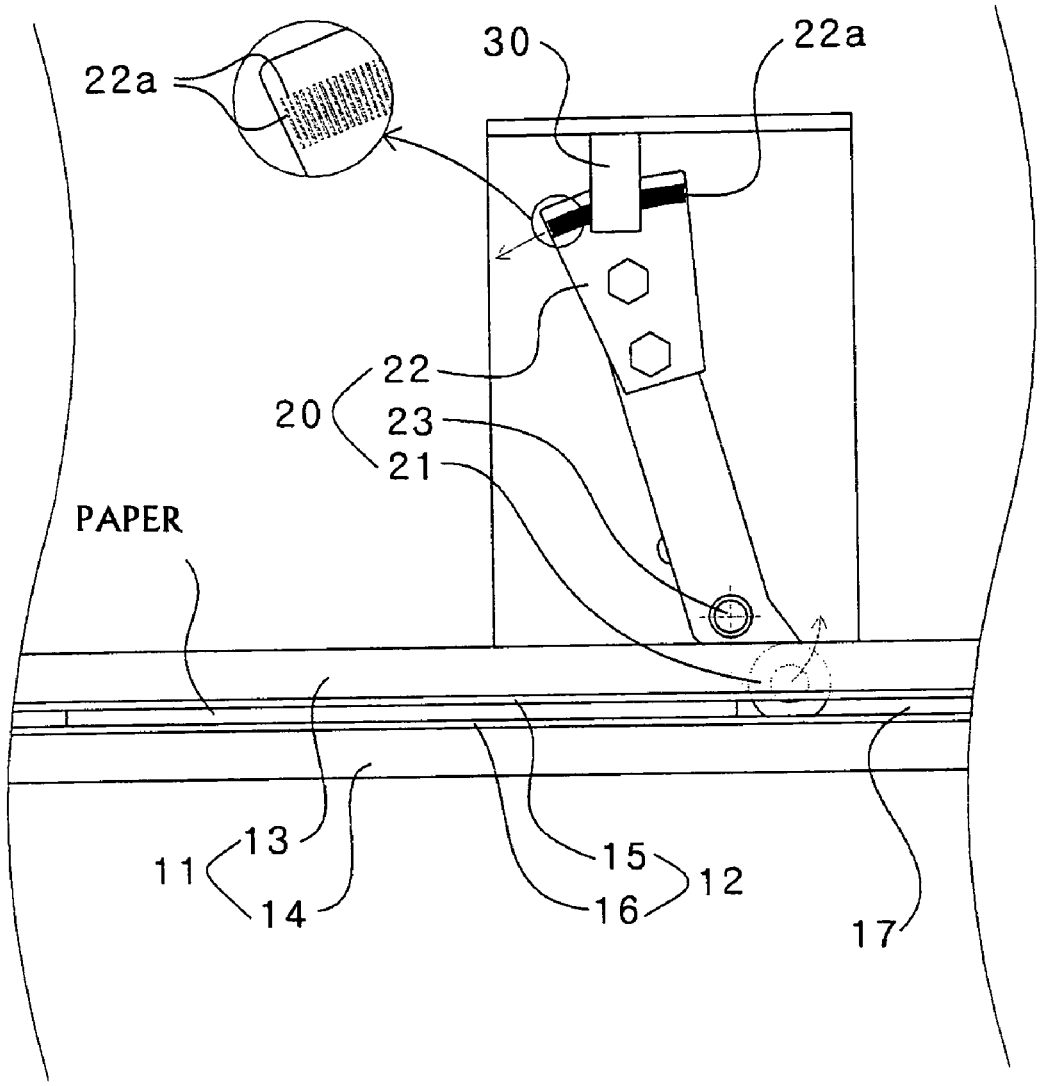

*[Fig. 4]*
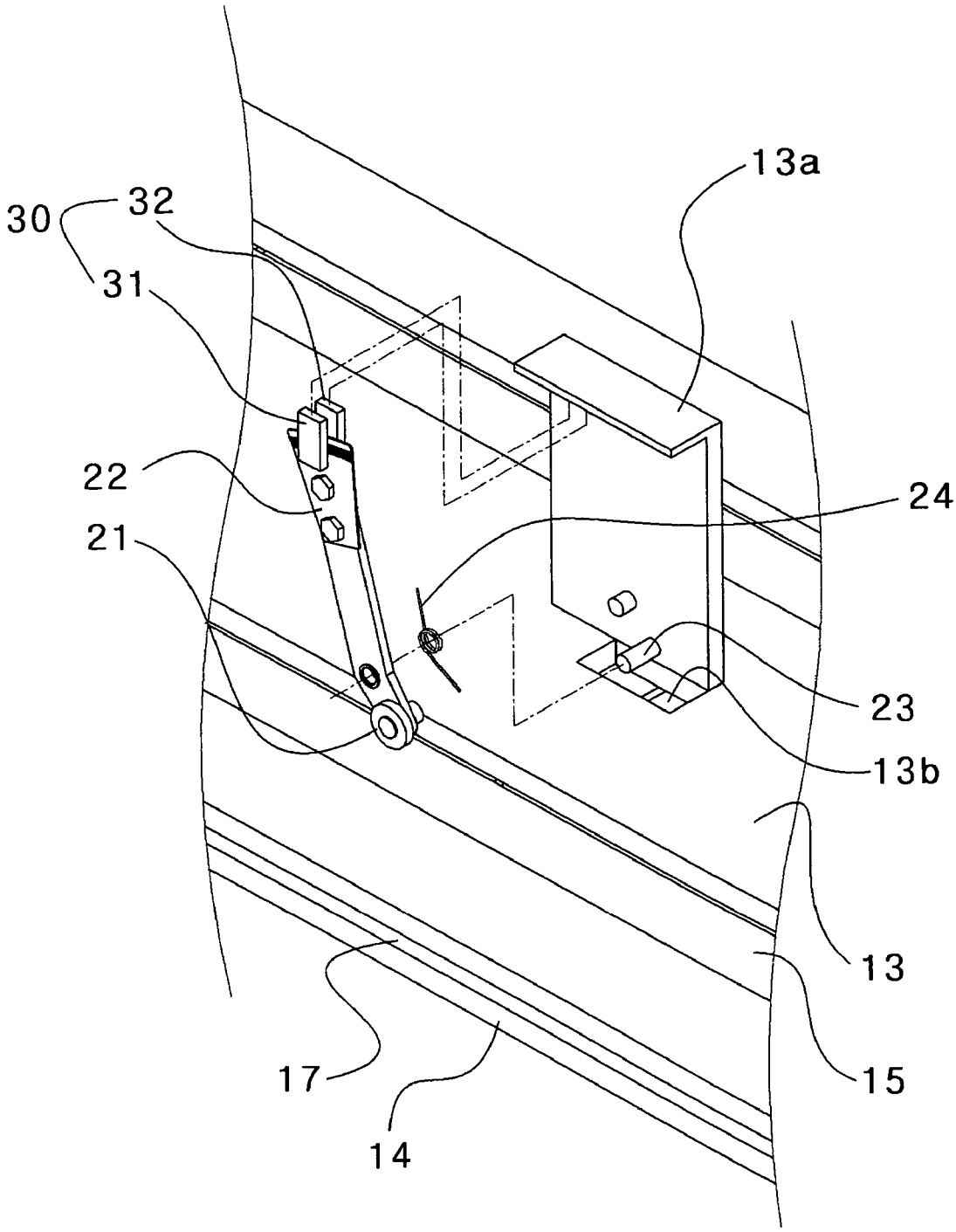

APPARATUS FOR DETECTING DOUBLE-FEED OF PAPER

CROSS-REFERENCE TO RELATED APPLICATIONS

This application claims priority under 35 USC § 119 to Korean Patent Application No. 10-2004-0112510 filed on Dec. 24, 2004, the contents of which are incorporated herein by reference in its entirety.

BACKGROUND OF THE INVENTION

1. Field of the invention

The present invention relates to an apparatus and method for detecting double-feed of paper in a paper handling machine, and more particularly to an apparatus and method for detecting double-feed of paper to prevent banking accidents or jam in a paper handling machine for handling paper, for example, currency note, where sheets of currency note are not separated by a sheet separating means and thus plural sheets are double fed.

2. Description of the Prior Art

A paper handling machine is a machine for handling or carrying currency note or paper.

For example, there are automatic teller machines (ATMs) for depositing or dispensing the currency note at a cash corner, printers for printing transaction particulars on paper, copying machines for conveniently and quickly copying documents or papers of a user onto plural sheets of paper stacked on a cartridge, and the like.

The paper handling machine generally includes a pickup roller for separating the paper sheet by sheet in a stacking space of paper and a feeding means (such as a belt or a feeding roller, for feeding a sheet of paper).

If two or more sheets of overlapped paper are fed in the paper handling machine, jam happens in the machine, which causes an error to occur in a paper handling processor of the paper handling machine that is optimized for the case where a sheet of paper is fed at a certain interval.

In particular, if the ATM feeds the overlapped currency note to dispense more money to a customer, the banking accident may occur.

In addition, when jam or error occurs in the paper handling machine, the paper handling machine has to be shut down and maintained by a manager, which causes an efficiency of the machine to remarkably deteriorate.

SUMMARY OF THE INVENTION

Accordingly, the present invention has been made to solve the above-mentioned problems occurring in the prior art, and an object of the present invention is to provide an apparatus and method for detecting double-feed of paper, in which in the case where plural sheets of overlapped paper are fed by a feeding means in a paper handling machine, such as an automatic teller machine, a printer or a copying machine, it detects the case to eliminate jam or an error occurring cause and prevent banking accidents, in particular, in the case of an automatic teller machine.

In order to accomplish this object, there is provided an apparatus for detecting overlay of paper, comprising: paper feeding means for guiding upper and lower surfaces of the paper and feeding the paper; a pivot member pivotally installed to a rotary shaft, and having a contact portion disposed in a paper feeding path of the paper feeding means and contacting with one surface of the feeding paper, and an encoder portion with a plurality of slits, in which the rotary shaft is closer to the contact portion rather than the encoder portion; and a sensor for counting the number of slits of the encoder portion when the pivot member pivots.

According to another aspect of the present invention, there is provided a method for detecting overlay of paper in a paper handling machine, comprising the steps of: feeding the paper such that a contact portion of a pivot member contacts with the paper; pivoting the pivot member around a rotary shaft; amplifying a minute shift amount of the pivot member using an encoder portion of the pivot member; and detecting the number of slits formed at the encoder portion.

BRIEF DESCRIPTION OF THE DRAWINGS

The above and other objects, features and advantages of the present invention will be more apparent from the following detailed description taken in conjunction with the accompanying drawings, in which:

FIG. 1 is a perspective view of an apparatus for detecting double-feed of paper according to an embodiment of the present invention;

FIG. 2 is an exploded perspective view of FIG. 1;

FIG. 3 is a plan view of FIG. 1; and

FIG. 4 is an exploded perspective view illustrating a pivot member in an apparatus for detecting double-feed of paper according to an embodiment of the present invention.

DETAILED DESCRIPTION OF THE PREFERRED EMBODIMENTS

Hereinafter, a preferred embodiment of the present invention will be described with reference to the accompanying drawings. In the following description and drawings, the same reference numerals are used to designate the same or similar components, and so repetition of the description on the same or similar components will be omitted.

FIG. 1 is a perspective view of an apparatus for detecting double-feed of paper according to an embodiment of the present invention, and FIG. 2 is an exploded perspective view of FIG. 1.

The apparatus of the present invention includes a paper feeding means 10 consisting of a paper guide 11 for guiding upper and lower surfaces of paper and a conveyor belt 12 for forcibly contacting the upper and lower surfaces of the paper and feeding the paper.

The paper guide 11 has an upper paper guide 13 and a lower paper guide 14 which are spaced apart from each other to form a gap, i.e., a paper feeding path 17, between the guides. The paper is horizontally guided along the paper feeding path 17.

The conveyor belt 12 is installed to belt mounting grooves 15*a* and 16*b* formed along a paper feeding direction of the paper guide 11.

The conveyor belt 12 has an upper conveyor belt 15 mounted to the belt mounting groove 15*a* of the upper paper guide 13, and a lower convey belt 16 mounted to the belt mounting groove 16a of the lower paper guide 14.

The conveyor belt 12 is forcibly contacted with the upper and lower surfaces of the paper to feed the paper.

A double-row type of the conveyor belt 12 is employed in the embodiment, but it is one example of a structure capable of stably feeding the paper.

Plural sheets of the paper is continuously fed sheet by sheet at regular intervals along the paper feeding path 17 between the paper guide 11 and the conveyor belt 12.

The upper paper guide 13 is formed with a through-hole 13*b*. A protruding fixture 13*a* protrudes upward from one side of the through-hole 13*b*, and is provided with a pivot member 20 and a sensor 30 for detecting the number of slits, which will be described hereinafter, so as to detect overlay of the paper.

FIG. 3 is a plan view of FIG. 1, and FIG. 4 is an exploded perspective view illustrating the pivot member in the apparatus for detecting double-feed of paper according to an embodiment of the present invention.

The pivot member 20 has a contact portion 21 extended towards the paper feeding path 17 of the paper feeding means 10 and having a lower end penetrating the through-hole 13*b* of the upper paper guide 13 and contacting with the upper surface of the lower paper guide 14 so as to contact with the upper surface of the feeding paper, and an encoder portion 22 formed with a plurality of slits 22*a* at a side opposite to the contact portion 21.

When the paper is fed to the paper feeding path 17 and then contacts with the contact portion 21, which may include a roller, the pivot member 20 pivots around a rotary shaft 23.

The pivot member 20 is pivotally coupled to the rotary shaft 23 formed at a lower part of the protruding fixture 13*a*, and pivots around the rotary shaft 23 when the paper is fed to the paper feeding path 17 and then contacts with the contact portion 21.

The pivot member 20 is urged by a torsion spring 24 provided to the rotary shaft 23 so that the contact portion 21 is constantly pressed against the paper.

Specifically, if the contact portion 21 is significantly heavier than the encoder portion 22 on the basis of the rotary shaft 23, the contact portion 21 contacts with the upper surface of the lower paper guide 14. When the pivot member 20 comes in contact with the upper surface of the paper, the pivot member 20 moves apart from the upper surface of the lower paper guide 14, and then the pivot member 20 returns to its original position by the weight of the pivot member. Preferably, the pivot member 20 contacts with the upper surface of the lower paper guide 14 by the torsion spring 24 to secure stability of operation and easy design a construction.

The contact portion 21 of the pivot member 20 penetrates the through-hole 13*b* formed at the upper paper guide 13, and is extended towards the paper feeding path 17 to come in contact with the paper.

The encoder portion 22 of the pivot member 20 pivots around the rotary shaft 23 when the paper passes the contact portion 21.

A shift amount of the encoder portion 22 of the pivot member 20 is measured by the sensor 30 consisting of a light emitting portion 31 and a tight receiving portion 32 which are optical sensors each installed to an upper part of the protruding fixture 13*a* to be opposite to front and rear surfaces of the slit 22*a* of the encoder portion 22.

The sensor 30 detects as a light if the light emitted from the light emitting portion 31 is incident on the light receiving portion 32 through the slit 22*a*, while detects as a dark if the light emitted from the light emitting portion 31 is intercepted by a portion between the slits 22*a* and thus is not incident on the light receiving portion 32. When the encoder portion 22 pivots, the sensor 30 detects the number of the light thereby to measure the number of slits 22*a*.

Specifically, when the contact portion 21 of the pivot member 20 comes in contact with the paper and then pivots around the rotary shaft 23, the sensor 30 counts the number of slits 22*a* of the pivoting encoder portion 22 to measure the shift amount of the encoder portion 22.

Alternatively, the apparatus for detecting overlay of the paper according to the present invention may include a controller (not shown) for receiving the detected signal from the sensor 30 to determine the overlay of the paper and for sounding an alarm to a user if the overlay of the paper is detected.

In addition, supposing that the sensor counts three slots when one sheet of paper passes, the controller can detect the number of the slits exceeding three when two or more sheets of paper pass. In this case, the controller determines the overlay of the paper.

It is difficult for the apparatus for detecting overlay of the paper according to the present invention to determine the overlay of the paper by use of the contact portion 21 directly contacting with the paper, since the paper is thin and a pivoting angle by the contacting pass of the paper and thus the shift amount of the contact portion 21 is minute. The more the encoder is apart from the rotary shaft 23, the more the shift amount of the encoder portion 22 is increased. Accordingly, the pivot member 20 serves as a kind of amplifier. When the pivot member 20 pivots, the sensor measures the number of the slits 22*a* of the encoder portion 22 to determine the overlay of the paper.

Since it is physically limited to widen a distance between the encoder portion 22 and the rotary shaft 23 to increase amplitude, the rotary shaft 23 is preferably installed to a position closest to the contact portion 21 rather than the encoder portion 22.

With the apparatus for detecting overlay of the paper according to the present invention, since the minute shift amount produced when the contact portion 21 of the pivot member 20 contacts with the paper fed from the paper feeding means 10 is amplified in the encoder portion 22 by the pivot member 20, the sensor 20 counts the number of the pivoting slit 22*a* to determine the overlay of the paper. In addition to the embodiment, therefore, a structure of feeding the paper may be applied in various types.

Also, although the pivot member 20 is pivotally installed to the paper guide 11 in the embodiment, the pivot member 20 may be pivotally installed to any fixed position, which is within the scope of the present invention.

With the above description, the present invention can accurately detect the overlay of the paper having a thin thickness with a simple construction. Also, the present invention can detect the overlay of the paper, regardless of the size and thickness of the paper and a transferring direction of the paper.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for detecting overlay of paper, comprising:

paper feeding means for guiding upper and lower surfaces of the paper and feeding the paper;

a pivot member pivotally installed to a rotary shaft, and having a contact portion disposed in a paper feeding path of the paper feeding means and contacting with one surface of the feeding paper, and an encoder portion with a plurality of slits, in which the rotary shaft is closer to the contact portion rather than the encoder portion; and a sensor for counting the number of slits of the encoder portion when the pivot member pivots, wherein the paper feeding means includes:

paper guides including an upper paper guide formed with a through-hole and a lower paper guide spaced apart from each other at a constant interval to form the paper feeding path between the two guides; and two conveyor belts installed to a belt mounting groove formed along a paper feeding direction for forcibly contacting the upper and lower surfaces of the paper and feeding the paper, wherein the upper paper guide includes a protruding fixture which protrudes upward from one side of the through-hole, wherein the pivot member is pivotally coupled to the rotary shaft formed at a lower part of the protruding fixture, wherein the pivot member includes a torsion spring for urging the contact portion against the paper, wherein the sensor includes a photo sensor including a light emitting portion and a light receiving portion which are disposed opposite to front and rear surfaces of the plurality of slits of the encoder portion and installed to an upper part of the protruding fixture, wherein the contact portion penetrates though the through-hole and includes a roller.

* * * * *